United States Patent [19]

Parkins

[11] 4,416,546

[45] Nov. 22, 1983

[54] BUOYANCY-RESPONSIVE DEVICE

[76] Inventor: Malcolm F. Parkins, Elm Tree Cottage, South End, Ogbourne St. George, near Marlborough, England

[21] Appl. No.: 355,583

[22] PCT Filed: Jul. 3, 1981

[86] PCT No.: PCT/GB81/00132

§ 371 Date: Feb. 23, 1982

§ 102(e) Date: Feb. 23, 1982

[87] PCT Pub. No.: WO82/00167

PCT Pub. Date: Jan. 21, 1982

[30] Foreign Application Priority Data

Jul. 4, 1980 [GB] United Kingdom ..... 8022093

[51] Int. Cl.[3] ..... B01F 13/02

[52] U.S. Cl. ..... 366/102; 366/276

[58] Field of Search ..... 60/495, 496; 137/38, 137/40, 44, 45; 261/77, 81, 83, 121 R, DIG. 47; 366/101, 102, 276, 280, 309, 349; 405/21, 22, 23, 52, 79; 422/224; 441/D68

[56] References Cited

U.S. PATENT DOCUMENTS 3,788,616 1/1974 Clough ..... 261/81 X 3,806,098 4/1974 Clough ..... 366/102

*Primary Examiner*—Robert W. Jenkins

*Assistant Examiner*—Arthur D. Dahlberg

*Attorney, Agent, or Firm*—William R. Hinds

[57] ABSTRACT

For automatically creating intermittent disturbances in slurry digesters, natural waters and the like, there is provide a device (c) to be immersed below the surface of fluid in the digester, below water level and adjusted to collect generated or supplied gas, the device being pivoted to swing about axis (P) from the collecting position to a gas discharge position and the collecting space being shaped adjacent its mouth so that, as it fills with collected gas, the line of action of the buoyant upthrust on the device moves relatively to the swinging axis until the upthrust causes swinging of the device to allow the gas to discharge as a massive bubble, and after discharge to return to a collecting attitude.

4 Claims, 3 Drawing Figures

BUOYANCY-RESPONSIVE DEVICE

This invention relates to a buoyancy-operated device, the purpose of which is to create repeated disturbances in a fluid in which the device is immersed.

In, for example, digesters in which a slurry of waste products is treated, it is necessary to break up and disperse any crust of solids tending to form on the slurry surface, to stir the slurry to prevent settlement of solids and to effect release of generated gases enabling them to be recovered in usable form.

One use of the device of the invention is in such digesters to create automatically repeated massive disturbances for effecting the described necessary operations.

Another use is to improve aeration of natural waters, e.g. lakes, and yet another use is in ice-breaking in natural waters.

According to the invention, there is provided a device for immersion in a first fluid to produce in it repeated disturbances, which device is hollow, open-mouthed and pivoted to swing between first and second positions, the arrangement in use being that in the first position, the mouth faces downwards and a second and lighter fluid can be collected in the device thereby to displace from it the first fluid whereby the effect of buoyant upthrust on the device is varied until the device becomes unstable and moves from the first position to the second position in which the second fluid is rapidly discharged from the device so that it returns to the first position.

In use of such device for example in a digester as above referred to, the device will be immersed in the slurry, constituting the first fluid, and the gases generated or injected gas or both will constitute the lighter fluid. The gases will be collected in the device, instead of rising to the surface as small bubbles or being absorbed, and, when the device becomes unstable and moves rapidly to the second position, the collected gases will be released as a massive bubble so creating a disturbance in the slurry sufficient to effect to a substantial extent the desired crust break up and "stirring" of the slurry and ensuring that at least a large proportion of the generated gases can be collected for use. The disturbance caused by each discharge of the lighter fluid will depend on the capacity of the device, its depth below the surface of the heavier fluid and the relative densities of the fluids. Injected gas may be gas collected from above the slurry and pumped back to beneath the device. When used for aeration of natural waters or for ice-breaking, the device will be located well below the surface of the water and the lighter fluid will conveniently be air pumped into the device. A small pump would be able to supply a number of the self-unstabilising devices.

Clearly the frequency of operation of the device will be determined by the rate of gas collection and the shape, weight and other characteristics of the device.

Figure 1:
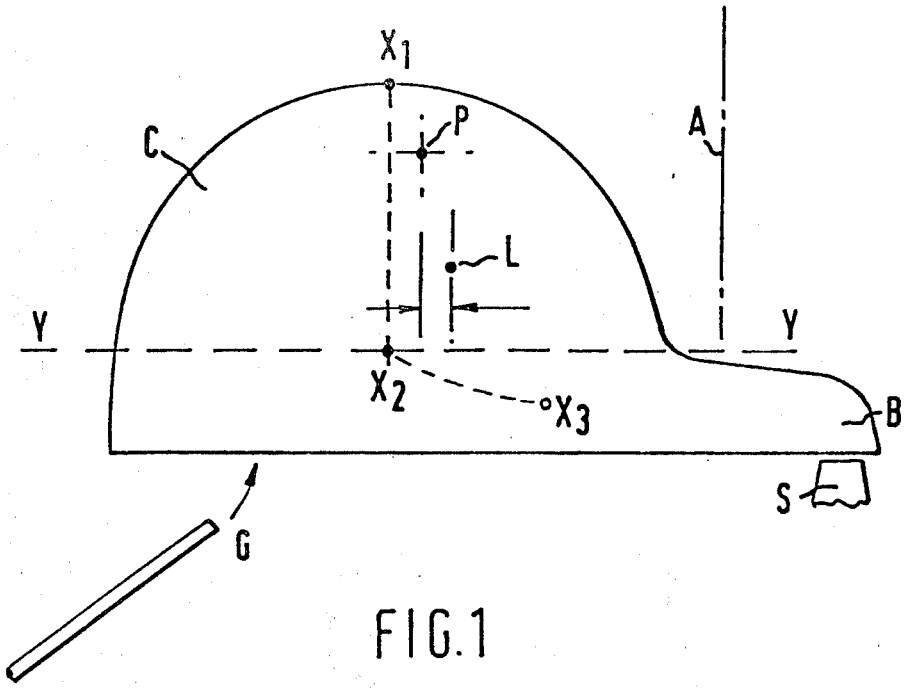
Figure 2:
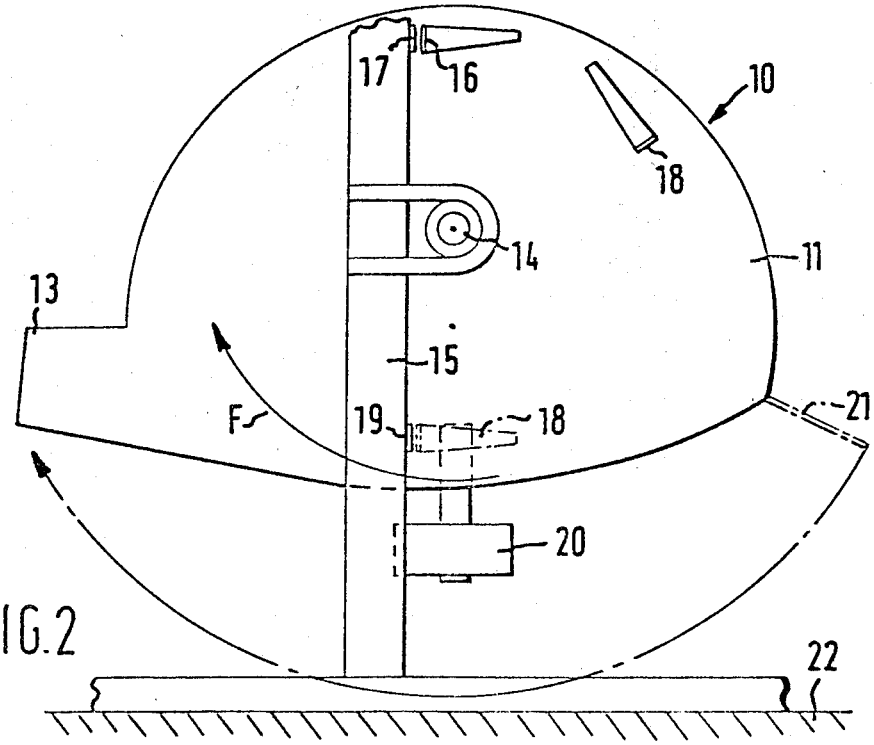
Figure 3:
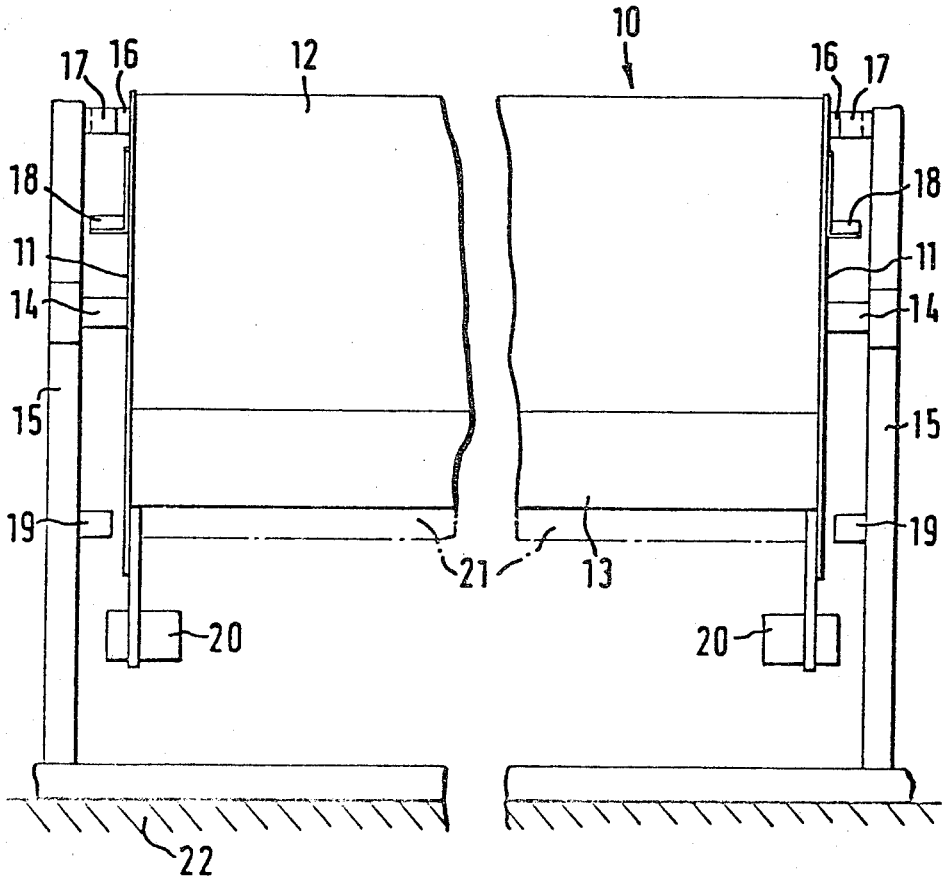

The principles of the device of the invention will now be described with reference to the accompanying drawings, of which FIG. 1 is a diagrammatic cross-section of one form of the device, FIG. 2 is a side elevation of a second form of the device, and FIG. 3 is a front elevation, partly broken away, of the device of FIG. 2.

The device shown in FIG. 1 has an open-mouthed, dome-shaped body C with a lateral beak B extending the downwardly facing mouth. The device is pivotally mounted about a horizontal axis p for limited swinging from a first position as shown against a stop S and a second position in which the mouth is substantially vertical as indicated by chain line A. The device is formed so that its centre of gravity is always between vertical planes through the pivotal axis P and the stop S. The upper portion of the collecting space above the beak B is substantially symmetrical about a vertical plane through axis P, but the beak B makes the lower portion asymmetrical about that plane.

Assume that the chamber within the body C is filled with the first fluid, e.g. slurry in a digester, and the lighter fluid, e.g. generated gas or gas supplied from pipe G, gradually fills the chamber.

The chamber is shaped such that as it fills, the path of the centre of area of the interface between the fluids, through which centre the line of action of the resultant buoyancy upthrust on the device extends, is shown by the dotted line $X_1$—$X_2$—$X_3$. It will be clear that the buoyancy upthrust initially tends to maintain the device against stop S, but once the interface reaches level Y—Y and the lighter fluid begins to displace the heavier fluid from the beak B, the centre moves along path $X_2$—$X_3$ until, when the buoyancy upthrust passes through a point L the turning moment of the upthrust overcomes the effect of the weight of the structure and any other resistances to turning and the device becomes unstable and starts to swing to the second position. This swinging moves the point L (to the left as seen in FIG. 1) so that the turning moment of the buoyancy upthrust increases and as a result there is rapid movement from the first position to the second position in which the collected lighter fluid discharges as a massive bubble creating a corresponding disturbance in the first fluid.

Thereafter, due to its weight the device returns to the first position and the cycle is automatically repeated.

The form of device shown in FIGS. 2 and 3 comprises a body 10 having plane end walls 11 and a basically part-cylindrical wall 12 extending between the walls 11 to form in use a collecting chamber for lighter fluid, and further having at one side of its downwardly-facing mouth a beak portion 13.

The body 10 is mounted in trunnions 14 in a fixed frame 15 to swing in the direction of arrow F between a first position (as shown) in which stops 16 on the body are against stops 17 on the frame 15 and a second position in which stops 18 on the body contact fixed stops 19 on the frame. In use, until the lighter fluid collected is sufficient to displace the heavier fluid from the beak 13, the buoyant upthrust is insufficient to move the device from the first position. However when the lighter fluid starts to fill the beak 13, the line of action of the buoyant upthrust moves to the left and away from the axis of rotation and ultimately overcomes the forces retaining the device in the first position and causes rapid movement to the second position. The lighter fluid is then discharged and the device swings back to the first position.

Counterweights 20 can be provided so that in the first position the centre of gravity of the rotatable assembly is well below the trunnions 14, but in the second position the centre of gravity is in a position such that the weight restores the device to the first position after discharge of the collected lighter fluid.

In another arrangement, the stops 16–19 are omitted and the device is free to rotate through a full circle on discharge of the lighter fluid. In this case the major portion of the device will be symmetrical about a plane containing the pivotal axis so as to be maintained against rotation until the interface between collected light fluid (e.g. gas) and the liquid (heavier fluid) penetrates the beak portion 13 sufficiently to displace the line of action of the buoyant upthrust to cause rotation.

Yet another feature illustrated in FIGS. 2 and 3 comprises the provision on the trailing edge of the mouth of the device a drag plate 21 which as the device turns sweeps close to the bottom 22 of the digester, for example, to disturb solids collecting on the bottom.

I claim:

1. A buoyancy-responsive device, for repeatedly disturbing a first fluid in which it is immersed, comprising a hollow body forming a chamber with an open mouth, which faces downwardly in a rest position of the body to collect a second, lighter, fluid rising from below, the body being pivoted about a horizontal axis and having its centre of gravity offset therefrom, so that the body by its weight tends to maintain the rest position but is capable of rotation to an unstable position, in which the mouth faces laterally, the chamber having an upper fluid-collecting portion which, in the rest position, is substantially symmetrical about a vertical plane so as to collect said lighter fluid and displace said first fluid downwardly without disturbing the body from its rest position, and the chamber also having a lower fluid-collecting portion which, in the rest position, is asymmetrical about said vertical plane and, due to buoyancy upthrust when sufficiently filled with collected lighter fluid, exerts a turning moment about said axis, overcoming the effect of the weight thereof, to swing said body from the rest position rapidly to discharge collected fluid through the mouth, the body thereafter returning to the rest position.

2. A buoyancy-responsive device as claimed in claim 1, in which the body is dome-shaped, forming the upper fluid-collecting portion substantially symmetrical about a vertical plane through the horizontal pivotal axis, the body having a laterally-extending beak forming the lower fluid-collecting portion, said beak extending laterally the downwardly-facing open mouth of the chamber, a stop being provided as an abutment for the beak to limit swinging of the body to a rest position, in which the open mouth faces downwardly, the body being free to swing away from the rest position to an unstable position in which the open mouth is substantially vertical and faces laterally.

3. A buoyancy-responsive device as claimed by claim 1, in which the body has a basically part-cylindrical wall extending about the horizontal pivotal axis between plane end walls and forming the upper fluid-collecting portion of the chamber and a beak portion extending from one side of the cylindrical wall to form the lower fluid-collecting portion, stops being provided on the body to limit swinging of the body between a rest position in which the open mouth faces downwardly and an unstable position in which the mouth faces laterally.

4. A buoyancy-responsive device according to claim 2 or 3, in which an edge of the chamber further from the beak portion and which trails in the direction of swinging from the rest position to an unstable position is provided with a drag plate.

* * * * *